United States Patent [19]

Balko

[11] 4,311,568

[45] Jan. 19, 1982

[54] ANODE FOR REDUCING OXYGEN GENERATION IN THE ELECTROLYSIS OF HYDROGEN CHLORIDE

[75] Inventor: Edward N. Balko, Wilmington, Mass.

[73] Assignee: General Electric Co., Wilmington, Mass.

[21] Appl. No.: 136,603

[22] Filed: Apr. 2, 1980

[51] Int. Cl.[3] ..... C25B 1/26; C25B 9/00

[52] U.S. Cl. ..... 204/128; 204/129; 204/266; 204/252; 204/283

[58] Field of Search ..... 204/128, 129, 266, 282, 204/283

[56] References Cited

U.S. PATENT DOCUMENTS

| | | | |
|---|---|---|---|
| 3,134,697 | 5/1964 | Niedrach | 136/86 |
| 3,297,484 | 1/1967 | Niedrach | 136/86 |
| 3,432,355 | 3/1969 | Niedrach et al. | 136/86 |
| 3,663,414 | 5/1972 | Martinsons et al. | 204/290 F |
| 3,720,590 | 3/1973 | De Witt et al. | 204/37 R |
| 3,840,443 | 10/1974 | Beer | 204/37 R |
| 3,992,271 | 11/1976 | Danzig et al. | 204/129 |
| 4,169,025 | 9/1979 | Needes | 204/128 |

*Primary Examiner*—R. L. Andrews

[57] ABSTRACT

An improved anode for use in the electrolysis of hydrogen chloride for the generation of chlorine gas in an electrolytic cell having a solid polymer electrolyte membrane with a cathode bonded to one side of the membrane and an anode bonded to the other side of the membrane, is described. The length of the diffusion path within the anode where the electrolytic oxidation takes place, is decreased or the porosity of the anode where the electrolytic oxidation takes place, is increased, to increase the rate of transport of the reactants (hydrogen chloride) and the reaction products (chlorine gas) within the anode. The diffusion path length is decreased by decreasing the thickness of the anode catalyst material. A preferred anode catalyst for the oxidation of an aqueous hydrogen chloride solution has a thickness of about 6.0 microns to about 50.0 microns.

17 Claims, 5 Drawing Figures

ANODE FOR REDUCING OXYGEN GENERATION IN THE ELECTROLYSIS OF HYDROGEN CHLORIDE

This invention relates to the electrolysis of hydrogen chloride, and more particularly, to improved anodes for electrolytic cells which generate chlorine from hydrogen chloride.

Hydrogen chloride is a reaction by-product of many manufacturing processes which use chlorine gas. For example, chlorine is used to manufacture polyvinylchloride and isocyanates, and hydrogen chloride is a by-product of these processes. In certain instances, there is no use for the hydrogen chloride resulting from these processes, and oxidation of the waste hydrogen chloride to produce chlorine is often used to generate chlorine so that the waste hydrogen chloride can be converted to a useful product and reused or recycled.

The recovery of chlorine from hydrogen chloride is possible by both electrochemical and thermochemical processes. The electrochemical, i.e., electrolytic, systems are generally more advantageous when smaller quantities of hydrogen chloride are involved such as those installations which have an annual production rate of less than 160,000 tons of hydrogen chloride.

Solid polymer electrolyte electrolysis systems have been used for the generation of chlorine from aqueous hydrogen chloride as well as from sodium chloride (brine) solutions. The solid polymer electrolyte membrane system used for hydrogen chloride electrolysis consists of a pair of catalytic electrodes in electrical contact with the surfaces of an ion exchange membrane, (also referred to herein as a solid polymer electrolyte membrane). Other conventional components of the electrolysis cell include means for delivering current and a current source as well as means for the delivery of reactants to the chambers and electrodes and means to remove the reaction products from the chambers. The electrolytic cells are divided into an anode chamber and a cathode chamber by the solid polymer electrolyte membrane which has the anode and the cathode physically attached, as by bonding or the like, to the surfaces of the membrane; the anode chamber being the chamber adjacent to the anode which is bonded to the solid polymer electrolyte membrane, and the cathode chamber being adjacent to the cathode which is bonded to the solid polymer electrolyte membrane surface.

In operation, aqueous hydrogen chloride is supplied to the anode chamber of the electrolytic cell. Hydrogen chloride diffuses into the anode from the aqueous hydrogen chloride medium, and chloride ion is discharged at or very near the anode/membrane interface. The proton ($H^+$) migrates across the membrane and is discharged at the cathode where it diffuses into the cathode chamber and is removed therefrom as molecular hydrogen. Some water is electro-osmotically transferred across the membrane by the proton flux, and a quantity of hydrogen chloride also diffuses through the membrane to the cathode chamber to form dilute hydrogen chloride in the cathode chamber. The chloride ion discharged at or near the anode/solid polymer electrolyte membrane interface converts to molecular chlorine and diffuses through the anode into the anode chamber and is removed from the anode chamber by suitable removal means. Depleted hydrogen chloride is removed from the anode chamber, and dilute hydrogen chloride is removed from the cathode chamber by suitable means. Generally, the depleted hydrogen chloride and a dilute hydrogen chloride are in aqueous form and are sufficiently low in hydrogen chloride content so that they can be discharged as waste or recycled for resaturation with HCl gas.

One of the disadvantages of the prior art electrolytic devices using a solid polymer electrolyte membrane with electrodes forming a part of the membrane has been the generation or evolution of oxygen which leads to the corrosion of the electrode components and current collector elements and generally contributes to the inefficiency of the electrolytic process. The oxygen evolution occurs when there is chloride starvation in the anode, and the cell current is sustained by the electrolysis of water derived from the aqueous medium in the aqueous hydrogen chloride and/or from water within the hydrated membrane according to the following equation:

$$2H_2O \rightarrow O_2 + 4H^{30} + 4e^-$$

The oxygen evolution reaction is suppressed by acidic pH which increases the reversible potential of the process and by high chloride ion concentration which facilitates the desired reaction. Thus, a high rate of transfer of hydrogen chloride to the reaction site (in the anode or at the anode/membrane interface) is beneficial to system operation.

Accordingly, it is the primary object of this invention to provide a method and device for improving the electrolysis of hydrogen chloride.

It is another object of this invention to provide a method and device for substantially reducing or eliminating oxygen evolution in an electrolysis cell of the type using a solid polymer electrolyte membrane with electrodes bonded to and forming a part of the surfaces of the membrane when chlorine is generated from aqueous hydrogen chloride.

It is another object of this invention to provide an apparatus and method which improves the rate of transfer of hydrogen chloride in an aqueous medium in the anode chamber of an electrolysis cell to the reaction site in the anode or at the anode/membrane interface.

Still another object of this invention is to provide a method and apparatus which permits the use of feed hydrogen chloride solutions of lower concentrations into the anode of an electrolytic device in which chlorine gas is generated from the hydrogen chloride.

Another object of this invention is to provide an apparatus and device which permits electrolysis of hydrogen chloride in an aqueous medium at higher current densities.

Other objects and advantages of the invention will become apparent as the description thereof proceeds.

It has been discovered that electrolysis of hydrogen chloride in an electrolytic cell having a solid polymer electrolyte membrane, an anode into which hydrogen chloride diffuses and oxidizes, the anode being bonded to one surface of the solid polymer electrolyte membrane, and a cathode bonded to the other surface of the solid polymer electrolyte membrane, is improved by decreasing the diffusion path length within the anode. The decrease in the diffusion path length in the anode increases the rate of transport of hydrogen chloride into the anode. It also increases the rate of transport of the reaction products out of the anode. Length of the diffusion path may be decreased by decreasing the thickness of the anode. True diffusion path length is related to tortuosity and electrode thickness.

It has also been discovered that electrolysis of hydrogen chloride in an electrolytic cell having a solid polymer electrolyte membrane, an anode into which hydrogen chloride diffuses and oxidizes, the anode being bonded to one surface of the solid polymer electrolyte membrane, and a cathode bonded to the other surface of the solid polymer electrolyte membrane, is improved by increasing the porosity of the anode catalyst material. The increase of porosity in the anode also increases the rate of transport of hydrogen chloride into the anode.

There is also provided a method for improving the electrolysis of hydrogen chloride in an electrolytic cell having a solid polymer electrolyte membrane, an anode catalyst into which hydrogen chloride diffuses and oxidizes to form reaction products, the anode being bonded to one surface of the solid polymer electrolyte and a cathode catalyst bonded to the other surface of the solid polymer electrolyte membrane, comprising decreasing the diffusion path length within the anode catalyst and increasing the rate of transport of hydrogen chloride in the anode catalyst.

The rate of hydrogen chloride transport to the chlorine evolution sites in the anode or at or near the anode/membrane interface is increased and optimized by decreasing the diffusion path in the anode or increasing the porosity of the anode or both. In accordance with the present invention, it has also been discovered that there is a decrease in oxygen generation when the diffusion path length is decreased in the anode or the porosity of the anode is increased or both.

In another aspect of the invention, there is an improved electrode for the electrolysis of hydrogen chloride in an electrolytic cell having a solid polymer electrolyte membrane, a porous anode into which hydrogen chloride diffuses and oxidizes, said anode being bonded to one surface of the solid polymer electrolyte membrane, and a cathode bonded to the other surface of the solid polymer electrolyte membrane, wherein the improvement comprises anode material bonded to the solid polymer electrolyte membrane in an amount which decreases the diffusion path length within the anode and thereby increases the rate of transport of hydrogen chloride into the anode. The amount of anode material which decreases diffusion path length, is that amount which decreases the thickness of the anode material in contact with the membrane surface. There is also an improved gas and liquid permeable electrode for the electrolysis of hydrogen chloride when the anode material has an increased porosity and when the amount of anode material is decreased with a resulting decrease in the thickness of the anode material in contact, and physically forming a part of, the membrane surface.

In another aspect of the invention, there is described a method for reducing the amount of oxygen generated in the electrolysis of hydrogen chloride in an electrolytic cell having a solid polymer electrolyte membrane, a cathode bonded to one surface of the solid polymer electrolyte membrane and an anode bonded to the other surface of the solid polymer electrolyte membrane wherein hydrogen chloride diffuses into the anode and oxidizes therein, comprising decreasing the length of the diffusion path within the anode, or increasing the porosity of the anode or both, and thereby increasing the rate of transport of hydrogen chloride into the anode.

In another apsect of the invention, the improvement comprises an anode having decreased diffusion path length or increased porosity or both to provide an increase in the rate of transport of hydrogen chloride into the anode, in an apparatus for the generation of chlorine from hydrogen chloride by electrolysis wherein the electrolysis is carried out in an electrolytic cell having a solid polymer electrolyte membrane with the anode bonded to one surface and a cathode bonded to the other surface of the solid polymer electrolyte membrane, the solid polymer electrolyte membrane dividing the electrolytic cell into an anode chamber on the side of the membrane having the anode and into a cathode chamber on the side of the membrane having the cathode, means for providing electrical current at the anode and the cathode, feed means for feeding hydrogen chloride into the anode chamber, means for removing chlorine and depleted hydrogen chloride from the anode chamber and means for removing dilute hydrogen chloride and hydrogen from the cathode chamber.

In accordance with the present invention, it has been found that by reducing the thickness of the anode and thereby decreasing the length of the diffusion path through which hydrogen chloride and the oxidation products of hydrogen chloride must pass, or by increasing the porosity of the anode, parasitic oxygen evolution is suppressed, substantially reduced or eliminated. It has been found that this permits the use of feed hydrogen chloride of lower concentrations and also permits electrolysis of hydrogen chloride at higher current densities. It has been found that the increased rate of transport permits the use of the hydrogen chloride at lower concentration in an aqueous or other medium and the operation of the electrolytic cell at a higher current density, and that the levels of oxygen in the evolving chloride gas in electrolytic cells having the improved anodes of the present invention are lower than the levels of oxygen in the chlorine gas of the prior art systems having thicker, less porous anodes.

These and various other objects, features and advantages of the invention can best be understood from the following detailed descriptions taken in conjunction with the accompanying drawings in which.

Figure 1:
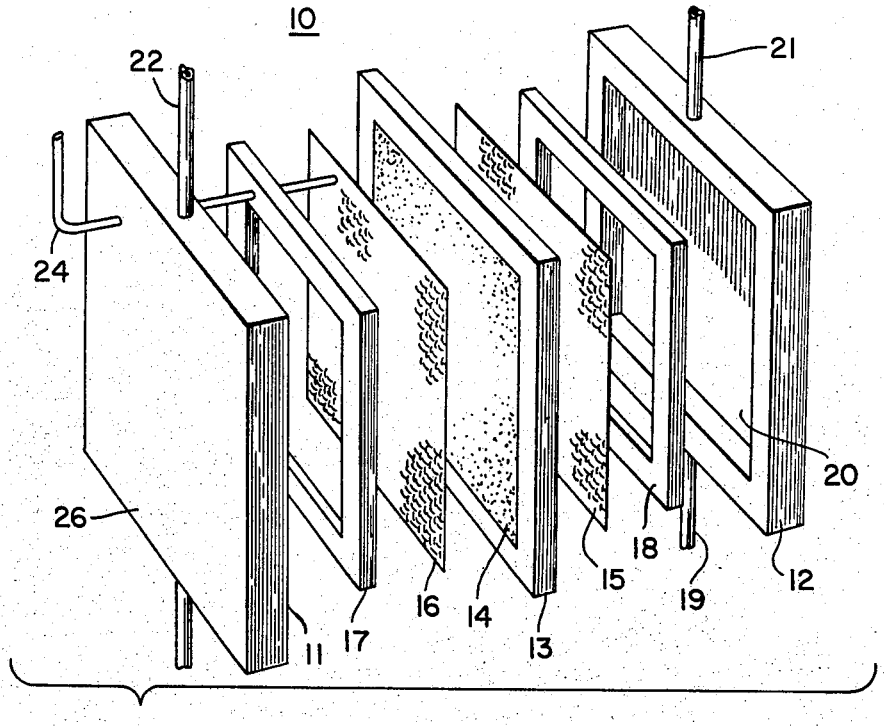
FIG. 1 is a diagrammatic illustration of a typical electrolysis cell for the generation of chlorine from aqueous hydrogen chloride.

In FIG. 1, a typical electrolysis cell is shown generally at 10 to illustrate the generation of chlorine from aqueous hydrogen chloride in accordance with the present invention. Electrolysis cell 10 consists of a cathode compartment or chamber 11, an anode compartment or chamber 20 and a solid polymer electrolyte membrane 13 which is preferably a hydrated permselective cation exchange membrane and separates cathode chamber 11 from anode chamber 20. The gas and liquid permeable electrodes are bonded to, and physically form a part of, the surfaces of solid polymer electrolyte membrane 13. Cathode 14 is bonded to one side of the solid polymer electrolyte membrane 13 and a catalytic anode (not shown) is bonded to the other side of solid polymer electrolyte membrane 13. Each of the respective electrodes physically forms a part of membrane 13 and is in electrical contact with a surface of the solid polymer electrolyte membrane 13. Cathode compartment 11 is located on the side of the solid polymer electrolyte membrane having the cathode thereon. Likewise, anode compartment 20 is located on that side of solid polymer electrolyte membrane 13 which bears the anode.

Typical of the composition of the anode material upon the surface of solid polymer electrolyte membrane 13 is an anode material having particles of a fluorocarbon, such as the fluorocarbon sold by E. I. Dupont de Nemours, & Co. under its trademark "TEFLON" bonded to stabilized reduced oxides of ruthenium or iridium, stabilized reduced oxides of ruthenium/iridium, ruthenium/titanium, ruthenium/titanium/iridium, ruthenium/tantalum/iridium, ruthenium/graphite and the like. The anode composition is not critical in the practice of the present invention. However, the anode material must be deposited upon, bonded to or otherwise physically made of part of the surface of the solid polymer electrolyte membrane. The porosity of the anode must be sufficient to permit the diffusion of hydrogen chloride into the anode and the diffusion of chlorine out of the anode. In accordance with the present invention, the porosity of the anode material must be increased, or the thickness of the layer of anode material bonded to the solid polymer electrolyte membrane must be decreased, or both to obtain the increased hydrogen chloride diffusion rate and the decreased oxygen generation.

The cathode, shown at 14, may be a Teflon-bonded cathode and is similar to the anode catalyst. Suitable cathode catalyst materials include finely-divided metals of platinum, palladium, gold, silver, spinels, manganese, cobalt, nickel, reduced platinum-group metal oxides, reduced platinum/ruthenium metal oxides, graphite and the like and suitable combinations thereof. The graphite or other catalyst materials deposited upon the surface of the solid polymer electrolyte membrane are not critical in the practice of the present invention and many well-known cathode materials may be used as the cathode in the present invention just as many well-known anode materials may be used as the anode of the present invention.

In one preferred embodiment, a graphite sheet (not shown in FIG. 1 but illustrated in FIG. 2 as numeral 36) may be used between cathode 14 and cathode current collector 16.

Current collectors in the form of metallic screens 15 and 16 are pressed against the electrodes. The entire membrane/electrode assembly is firmly supported between the housing elements 12 and 26 by means of gaskets 17 and 18 which are made of any material resistant to or inert to the cell environment, namely, chlorine, oxygen, hydrogen chloride or aqueous hydrogen chloride and the like. One form of such a gasket is a filled organic rubber gasket of ethylene propylene terpolymer sold by the Irving Moore Company of Cambridge, Mass. and commonly known as EPDM rubber. Another preferred gasket material is lead oxide cured VITON. VITON is a trademark of E. I. duPont de Nemours and Co. Gaskets 17 and 18 may be any suitable seaing means including cement to secure the elements together or O-rings to seal the respective chambers. In certain embodiments gaskets or cement 17 and 18 may be omitted.

The aqueous hydrogen chloride solution, generally a waste product from a chemical processing plant, is introduced through electrolyte inlet 19 which communicates with anode chamber 20. Spent electrolyte (hydrogen chloride) and chlorine gas are removed through outlet conduit 21 which also passes through housing 12.

An optional cathode inlet conduit (not shown) may communicate with cathode chamber 11, that is, the chamber formed by housing element 26, gasket 17 and cathode 14, to permit the introduction of optional, water or any other suitable aqueous medium into the cathode chamber. The cathode inlet conduit is optional, and generally there is no advantage in circulating catholyte through cathode chamber 11 in the electrolysis of hydrogen chloride. Cathode outlet conduit 22 communicates with cathode chamber 11 to remove the dilute aqueous hydrogen choride which migrates through membrane 13, hydrogen discharged at the cathode, and any excess water or other catholyte. A power cable or lead 24 is brought into the cathode chamber and a comparable cable or lead (not shown) is brought into the anode chamber. The cables connect the current conducting screens 15 and 16 to a source of electrical power (not shown).

In operation, aqueous hydrogen chloride is supplied to anode chamber 20 in the cell of FIG. 1. Hydrogen chloride diffuses into the anode (not shown) from the bulk feed aqueous hydrogen chloride. Chloride ion is discharged in the anode at or very near the anode/solid polymer electrolyte membrane interface, and protons ($H^{30}$) migrate across membrane 13 and are discharged as hydrogen at cathode 14. Some water is electroosomotically transferred across membrane 13 by the proton flux, and a quantity of hydrogen chloride diffuses through solid polymer electrolyte membrane 13 to cathode chamber 11.

The membrane potential which is established by the difference in acid activity across the membrane is exactly compensated by the change in cathode potential due to the lower proton activity, and the electrolytic cell operates as if both electrodes were immersed in acid of the anode concentration. Thus, a separate cathode feed (cathode inlet conduit) is optional, and there is generally no advantage to the separate cathode feed.

Figure 2:
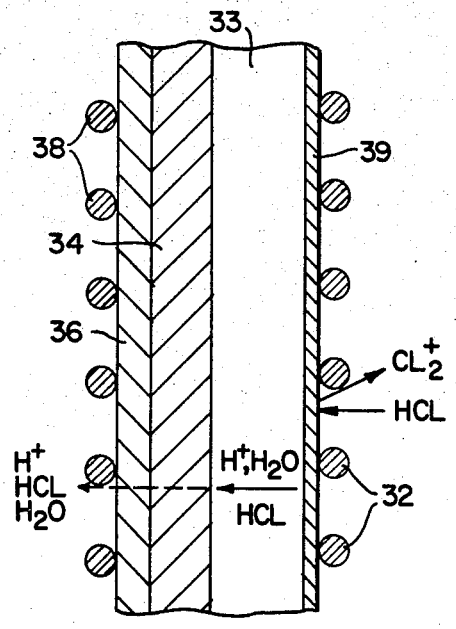
FIG. 2 is a schematic illustration of the electrodes and the solid polymer electrolyte membrane as well as the major reactions which take place in this portion of the electrolytic cell.

In FIG. 2, there is illustrated a cross-section of a portion of the electrodes, solid polymer electrolyte membrane, and current collectors in a preferred electrolytic cell configuration showing the improved anode of the invention. The major reactants and reaction products and their migration through the electrodes and solid polymer electrolyte membrane are schematically represented in FIG. 2. Porous anode 39 is bonded to one surface of solid polymer electrolyte membrane 33, and porous cathode 34 is bonded to the other surface of solid polymer electrolyte membrane 33. Anode current collector 32 is a metallic point contact collector and is in electrical contact with porous anode 39. Current collector 38 is a metallic point contact collector and is in electrical contact with graphite sheet 36 which in turn contacts cathode 34. Point contact collectors, corrugated metal contact devices, metal screens and various other conductive current collectors may be used in electrical contact with the electrodes. Porous anode 39 and porous cathode 34 are bonded to solid polymer electrolyte 33 in any well-known manner to establish electrical contact between the electrode and the respective surface of solid polymer electrolyte membrane 33. The decreased thickness of anode 39 relative to cathode 34 is evident from the illustration in FIG. 2, however, the embodiment shown in FIG. 2 is not necessarily drawn to scale. It can be seen in FIG. 2 that the diffusion path in porous anode 39 is relatively short or substantially decreased over the length of the diffusion path in cathode 34. In accordance with the present invention, the length of the diffusion path in porous anode 39 can be decreased by decreasing the thickness of anode 39. The diffusion rate of hydrogen chloride can also be increased by increasing the porosity of anode 39.

In FIG. 2, it can be seen that hydrogen chloride generally in aqueous solution, diffuses into porous anode 39. In porous anode 39 the hydrogen chloride is oxidized to hydrogen ion ($H^+$) and chloride ion ($Cl^+$), and the chloride ion ($Cl^+$) is further oxidized to chlorine gas ($Cl_2$). Protons ($H^+$) and water are transported through solid polymer electrolyte membrane 33 which is preferably a permselective cation exchange membrane well-known in the art, along with small amounts of hydrogen chloride. The hydrogen chloride and water form a dilute hydrogen chloride in the cathode chamber, and hydrogen ion ($H^+$) is converted to hydrogen gas ($H_2$).

In a parasitic side reaction, oxygen gas is formed at the anode and becomes mixed with the chlorine gas. As described above, this parasitic reaction is very undesirable in the hydrogen chloride electrolysis system because the evolution of oxygen decreases cell efficiency and leads to rapid corrosion of graphite and other electrode components and current collector elements in the cell. This parasitic side reaction resulting in oxygen evolution sustains the cell current when there is chloride starvation at the anode, that is, when there is insufficient chloride diffusing into the anode for oxidation at oxidation sites within the anode or at the anode/solid polymer electrolyte membrane interface. The parasitic oxygen evolution reaction may be illustrated as follows:

$$2H_2O \rightarrow O_2 + 4H^+ + 4e^-$$

The decreased length of the diffusion path within anode 39 of FIG. 2 or the increased porosity within anode 39 of FIG. 2 or both, in accordance with the present invention, substantially reduces or eliminates this parasitic reaction by providing a greater amount of diffusion of the hydrogen chloride into the anode so that the hydrogen chloride can be oxidized at oxidization sites within the anode or at the anode/solid polymer electrolyte membrane interface. The decreased length of the diffusion path or the increased porosity within the anode also permits an increased rate of transport of the chlorine gas from the reaction or oxidation sites within the anode or at the anode/solid polymer electrolyte membrane interface, into the anode chamber. It has been found that the rate of transport of the hydrogen chloride, the chlorine gas and other reactants and products is substantially increased when the thickness of the anode is decreased or the porosity of the anode is increased or both. The prior devices having anodes of at least 100 microns in thickness result in a substantially greater volume percentage of oxygen in the chlorine gas produced by the electrolysis of hydrogen chloride in the anode compartment than the electrolysis cells of the present invention wherein the anodes are less than 100 microns in thickness and preferably about 6.0 microns to about 50.0 microns in thickness. The most preferred embodiment appears to be realized when the thickness of the anode is about 10.0 microns to about 13.0 microns. This improvement is illustrated in the graph in FIG. 4 where the molarity of spent hydrogen chloride in water is plotted against the volume percent of oxygen contamination in chlorine gas effluent from the anode compartment of an electrolysis cell having a feed stream of aqueous hydrogen chloride.

Figure 4:
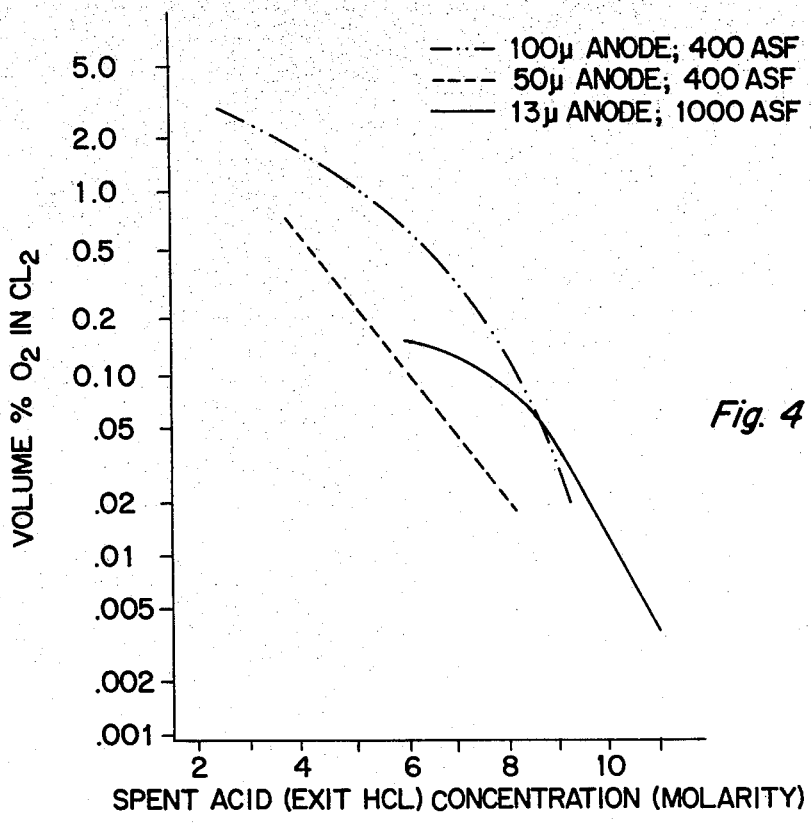
FIG. 4 is a graph illustrating the effect of anode thickness reduction on oxygen content in chlorine gas prepared by the oxidation of hydrogen chloride in an electrolytic cell.

The graph in FIG. 4 shows the volume percent of oxygen in the stream of chlorine gas for anodes which are 100 microns in thickness, 50 microns and 13 microns in thickness. Although the cell current differs between the 13 micron thick anode material and the 50 and 100 micron thick anode materials in the graph representation in FIG. 4 showing the effect of anode thickness reduction on oxygen content in effluent chlorine gas, the results are even more significant because at 1,000 amps/ft.$^2$, chloride ion is consumed at a rate 250% greater than at 400 amps/ft.$^2$, yet the embodiment having a 13 micron thick anode has a substantially lower oxygen level at acid concentrations greater than 9 moles. At 400 amps/ft.$^2$, the oxygen levels from the 13 micron thick anode are very low, as shown in FIG. 4. The best cell performance for the electrolytic hydrogen chloride was demonstrated in an electrolytic cell having an anode (graphite) 6 microns thick. In that cell, the oxygen level was 0.1% by volume in the chlorine gas exiting from the anode chamber when the anolyte was a 4.5 molar aqueous hydrogen chloride, and the cell was operated at 600 amps/ft.$^2$.

In the electrolysis of hydrogen chloride in accordance with the present invention, the transport of the hydrogen chloride into the anode occurs primarily by diffusion. When the rate of hydrogen chloride consumption in the anode exceeds the rate at which it is supplied by the diffusive transport, oxygen is concurrently evolved with the chlorine. As explained above, the oxygen is an undesirable contaminant in the chlorine gas product because it leads to decreased cell efficiency and corrosion of cell components. It is for this reason that the invention is directed to increasing the rate of hydrogen chloride transport into the anode by decreasing the length of the diffusion path. This is accomplished by decreasing the thickness of the anode relative to a reduction in the tortuosity of the diffusion path. The rate of hydrogen chloride transport into the anode may also be increased by increasing the porosity of the anode or by both reducing the thickness of the anode and increasing the porosity of the anode. This increased rate of transport permits the use of hydrogen chloride of lower concentrations and permits the operation of the electrolysis cell at a higher current density with the resulting levels of oxygen in chlorine gas being lower than that of the prior art systems. In accordance with the present invention, it is the length of the diffusion path, that is, the thickness of the anode material, and/or the porosity of the anode material which is critical. The thickness and porosity of the cathode is not a critical aspect in the present invention, and standard thicknesses generally apply to the cathode material.

In accordance with the present invention, control of the tortuosity of the diffusion path relates to the length of the diffusion path, and generally the tortuosity remains constant in the anode. The relationship between diffusion path length, tortuosity and electrode thickness is as follows:

DIFFUSION PATH LENGTH = TORTUOSITY × ELECTRODE THICKNESS where tortuosity is a constant.

By tortuosity, as used herein, is meant repeated twists, bends, turns, windings, and the general circuitousness of channels or pores within the anode material. Thus, an increase in pore size can result in increased communication between pores and channels within the anode material and thereby result in an increase in the diffusion rate at which hydrogen chloride and the oxidation products of hydrogen chloride diffusively pass into, through and out of the anode material.

In the anode material in electrical contact with the solid polymer electrolyte membrane in the electrolytic cells of the present invention, hydrogen chloride is transported to the interface of the anode material and the membrane by both diffusion and convective motion of the pore liquid caused by the transfer of solvents (water) across the membrane. Hydrogen chloride leaves the pore liquid by two mechanisms. One by consumption in the electrode reaction and the other by diffusion across the membrane. Diffusion of hydrogen chloride within the electrode occurs only within the pore liquid. Since the pores are formed by a bed of randomly oriented particles, the true diffusion path is greater than the anode thickness. Thus, tortuosity and porosity become important factors in the oxidation reaction which takes place within the anode material or at the interface between the anode and the solid polymer electrolyte membrane. Porosity can be particularly troublesome because the pores in the anode become partially obstructed with gas. The present invention which decreases the length of the diffusion path by decreasing the thickness of the anode and/or increasing the porosity of the anode overcomes these disadvantages and difficulties.

Additional information relating to the construction and operation of electrolysis cells having catalytic electrodes bonded to the surface of a solid polymer electrolyte membrane for the production of halogens can be found in U.S. application Ser. No. 922,316, filed July 6, 1978 by T. G. Coker et al under the title "Production of Halogens by Electrolysis of Alkali Metal Halides In an Electrolysis Cell Having Catalytic Electrodes Bonded to the Surface of a Solid Polymer Electrolyte Membrane now U.S. Pat. No. 4,224,121." Other similar electrolysis cells and components of electrolysis cells are described in the prior art including U.S. Pat. No. 3,992,271 relating to a method for gas generation.

The catalytic electrodes may be constructed by any of the techniques well-known in the art. Anode and cathode materials may be prepared by the Adams method or by modifying the Adams method or by any other similar techniques. Anodes of decreased thickness may be prepared as decals and suitably bonded to the surface of solid polymer electrolyte membranes, or they may be made by the dry process technique which embraces abrading or roughening the surface of the solid polymer electrolyte membrane, preferably to place a cross-hatched pattern in the surface of the membrane and fixing a low loading of anode catalyst particles upon the patterned surface, or they may be made by any well-known prior art process. In the dry process technique described in a co-pending patent application Ser. No. 125,825 filed Feb. 29, 1980 by Richard J. Lawrance and Linda D. Wood entitled "Method of Making Solid Polymer Electrolyte Catalytic Electrodes and Electrodes Made Thereby" and assigned to the instant assignee, anode catalyst material is applied to the surface of a solid polymer electrolyte membrane by first roughening the surface of the solid polymer electrolyte membrane; depositing anode catalyst particles upon the roughened surface, e.g., by heat and/or pressure. The membrane is preferably in a dried state during the process and may be suitably hydrated after the fixing of the anode catalyst. A preferred cross-hatched pattern is placed in the membrane surface during the roughening step or steps by sanding the membrane with an abrasive in a first direction followed by sanding the membrane with the abrasive in a second direction, preferably at a 90° angle to the first direction.

Ion exchange resins and solid polymer electrolyte membranes are described in U.S. Pat. No. 3,297,484 where catalytically active electrodes are prepared from finely-divided metal powders mixed with a binder such as polytetrafluoroethylene resin, and the electrode comprises a bonded structure formed from a mixture of resin and catalyst bonded upon each of the two major surfaces of a solid polymer electrolyte solid matrix, sheet, or membrane. The resin and catalyst are formed into an electrode structure by forming a film from an emulsion of the material; or alternatively, the mixture of resin binder and catalyst material is mixed dry and shaped, pressed and sintered onto a sheet which can be shaped or cut to be used as the electrode, and bonded to the solid polymer electrolyte membrane. The resin and catalyst powder mix may also be calendared, pressed, cast or otherwise formed into a sheet or decal, or fibrous cloth or mat may be impregnated or surface coated with a mixture of binder and catalyst material. In other prior art techniques, the electrode material may be spread upon the surface of an ion exchange membrane or on the press platens used to press the electrode material into the surface of the ion exchange membrane, and the assembly of the ion exchange membrane and the electrode materials are placed between the platens and subjected to sufficient pressure preferably at an elevated temperature sufficient to cause the resin in either the membrane or in the admixture with the electrode catalyst material either to complete the polymerization if the resin is only partially polymerized, or to flow if the resin contains a thermoplastic binder. The method of bonding the electrode or electrodes to the surface of the membrane so that they physically form a part of the membrane in accordance with the present invention is not critical, and any of the well-known prior art techniques may be used as long as the gas and liquid permeable anode of reduced thickness and/or increased porosity results from the process to produce an anode having a reduced or decreased length of diffusion path or increased porosity.

Porosity may be increased by any well-known prior art techniques. One method of increasing the porosity is by incorporating solvent-soluble additives or particles in the anode material prior to the formation of the anode, thereafter forming the anode and treating the anode with solvents to remove the solvent-soluble material therefrom. For example, solid calcium carbonate of suitable size can be incorporated in the anode material before the anode is formed and dissolved by using mineral acid after the anode is formed. Increased porosity can also be accomplished electrochemically by incorporating additives in the anode material which can be removed electrochemically after the formation of the anode in the desired form or after the anode material has been deposited upon the surface of a solid polymer electrolyte membrane.

It is also within the purview of one skilled in the art to include additives which vaporize by heating or sintering, into the anode material prior to the formation of the anode and thereafter removing the vaporizable material by the application of heat. This step may occur simultaneously or concurrently with the sintering of the anode material.

The porosity in the anode may also be increased by increasing the particle size of the powder components, e.g., the particle size of the metal, metal oxide, metal alloy and/or binder material such as Teflon, which are used to form the anode. For example, by increasing the size of the powder components from 2–5 microns in diameter to 8–10 microns in diameter, the resulting anode will have a greater porosity, that is, the pores or channels in the anode material will be larger, and the diffusion rate of hydrogen chloride through the anode will be improved. However, in accordance with the present invention, it was also discovered that the parasitic generation of oxygen is substantially reduced or eliminated when the porosity, that is, pore size, or number of pores or both is increased.

The porosity of the anode may also be increased by increasing the irregularities in the shape of the solid or powdery components, particles or elements of the anode material, or by increasing the size or number of irregularities upon the surfaces of powder components in the anode material. For example, a spheroidal-shaped particle will have little or no irregularity upon its surface, but if the surface is distorted or stressed, the irregularities upon the surface increase, and when such particles are used as components of the anode material, the anode porosity will be greater or increased. Porosity is a function of structure. Therefore, packed flakes result in a less porous anode than packed spheres, and packed particles having irregular shapes result in a more porous anode than packed spheres. Accordingly, porosity can be increased by changing the geometry and surface irregularities in the particles.

As used herein, an increase in porosity may be an increase in the size of the pores or channels within the anode or an increase in the number of pores or channels within the anode, or both, and such an increase will result in increased hydrogen chloride diffusion and decreased parasitic oxygen generation.

Generally, porosity or void volume of the prior art anodes is about 50% or less (by volume). In accordance with the present invention, the porosity or void volume is preferably increased at least 20% (by volume) and most preferably by at least 50%. Thus, preferred void volumes or porosity are at least about 60% and more preferably at least about 75%. The upper limit of porosity is that void volume wherein the pore volume is so great that there is insufficient electrical continuity for the flow of current and/or an insufficient number of catalytic reaction sites in the anode catalyst. Generally, the void volume is increased in accordance with the present invention to a void volume of 60% up to a void volume of 90%. As used herein, void volume or porosity is that volume in the anode catalyst which is free of catalyst material and is generally that part of the anode element which comprises pores, channels, conduits and the like, through which gases and fluids pass and/or which gases and fluids occupy within the anode material.

Any of these foregoing techniques or similar techniques which increase the porosity of the anode material or decrease the diffusion path length may be used to obtain the improved electrodes and methods in accordance with the present invention. These techniques may also be significant factors in decreasing the tortuosity of the channels and pores within the anode material and may promote the intercommunication of channels and pores within the anode material and thereby increase diffusion rate of reactants and reaction products therein.

The following examples are presented for purposes of illustration only, and the details therein should not be construed as limitations upon the true scope of the invention as set forth in the claims.

EXAMPLE 1

Figure 3:
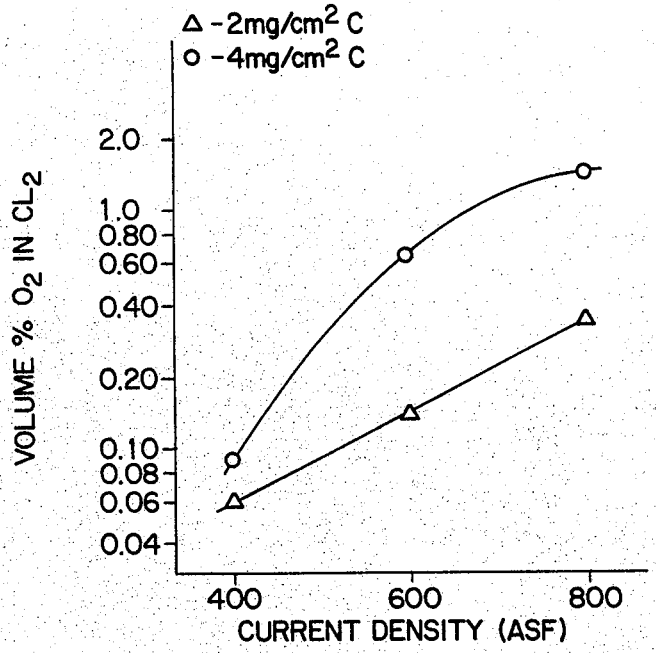
FIG. 3 is a graph illustrating the improved current density in an electrolytic cell which utilizes an anode of reduced thickness in the preparation of chlorine from aqueous hydrogen chloride.

Two porous electrode members having an anode upon one surface of a solid polymer electrolyte membrane and a cathode upon the other surface of the solid polymer electrolyte membrane, identical in construction except for the loading of the anode material, i.e., thickness of the anode material were prepared for testing. Both electrode elements had 75% ruthenium oxide/25% iridium oxide supported upon graphite as electrode catalysts. One of the anodes was prepared at the prior art loading (thickness) of 4.0 mg. graphite per $cm.^2$. This resulted in an anode thickness of 100 microns. The other anode was prepared at a loading of 2.0 mg. graphite/$cm.^2$, and this produced an anode having a thickness of 50.0 microns. The anode surface area in both cases was 9 $in^2$ (7.6 cm$\times$7.6 cm. or 58 $cm^2$). These membrane/electrode combinations were then employed in an electrolytic cell similar to the one described above and illustrated in FIG. 1 and FIG. 2 and used for the electrolysis of aqueous hydrogen chloride. The graph in FIG. 3 illustrates the amount of oxygen in volume percent in the chlorine gas produced in the electrolysis of the aqueous hydrogen chloride at the two different thicknesses of anode when the cell was operated at a constant concentration of hydrogen chloride (constant percent hydrogen chloride conversion of 3.5 percent) at varying current densities and an 8.0 molar aqueous hydrogen chloride feed stream. It can be seen from the graph that the anode of reduced thickness, the one designated by the triangles in the curve, was superior at all current densities measured as amps/$ft.^2$. The current collectors employed in this experiment were metallic distributor screens. The cathodes were 100 microns thick and were made of platinum black.

EXAMPLE 2

Another experiment was conducted to show the effect of anode thickness reduction on oxygen content in chlorine. Cell components and conditions, unless otherwise specified, were the same as those set forth in Example 1. Three different anode thicknesses were compared. One anode comprising the oxide of 75% ruthenium/25% iridium upon graphite was 100 microns thick and the cell was run at 400 amps/$ft.^2$. Another anode made of the same material was 50 microns thick, and the electrolytic cell for the oxidation of spent aqueous hydrogen chloride was run at 400 amps/$ft.^2$. A third anode made of the same anode material was 13 microns thick, and the electrolytic cell was run at 1000 amps/ft.$^2$. The results were reported in concentration of the spent acid (molarity) versus the volume percent of evolved oxygen in evolved chlorine gas. The results are reported in the graph in FIG. 4 and clearly demonstrate the influence of the anode thickness, i.e., diffusion path length, on the amount of oxygen in the effluent chlorine gas.

Figure 5:
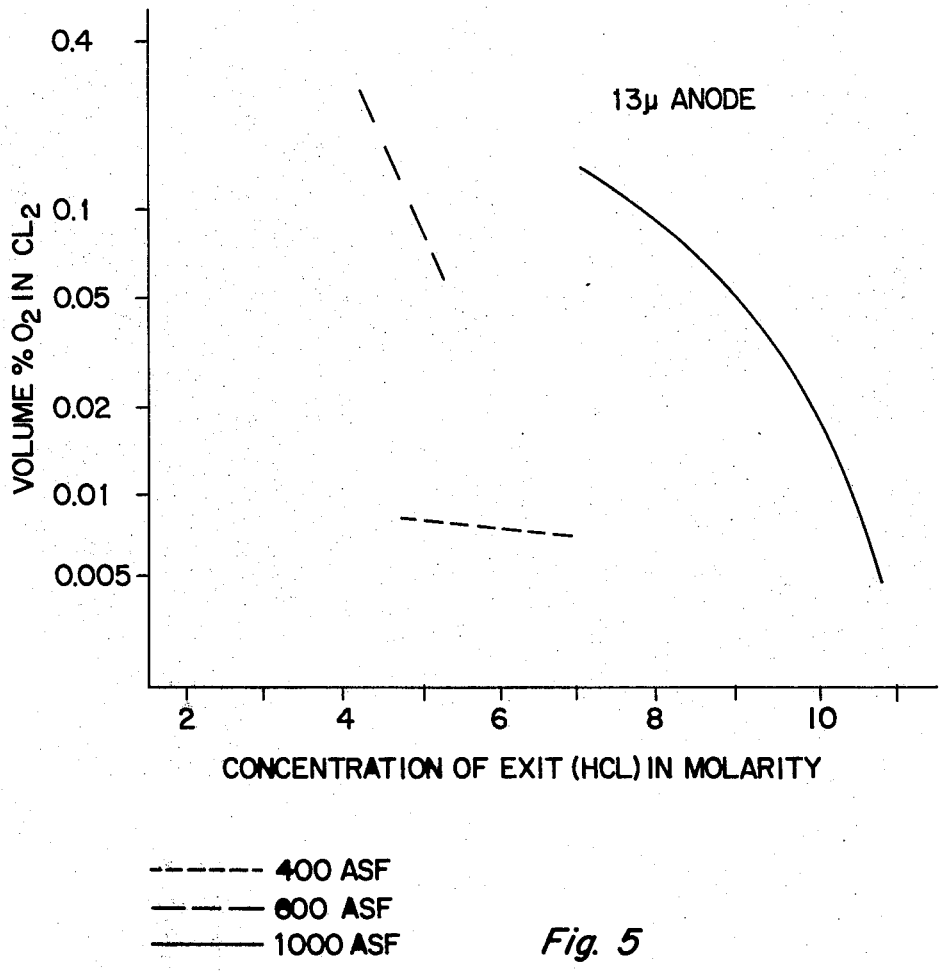
FIG. 5 is a graph illustrating the volume percent of oxygen in effluent chlorine gas at various current densities relative to the concentration in moles of effluent aqueous hydrogen chloride.

The results are even more striking when it is noted that at 1000 amps/ft.$^2$, chloride ion is being consumed at a rate which is 250% greater than at 400 amps/ft.$^2$, even though the anode which is 13 microns thick has a substantially lower oxygen level at acid concentrations greater than 8.0 moles. As shown in FIG. 5, at 400 amps/ft.$^2$ the oxygen levels (reported in volume percent in the graph) in chlorine from the anode having a 13-micron thickness are exceedingly low.

EXAMPLE 3

In another series of comparative experiments, electrolytic cells similar to those described and illustrated in FIG. 1 above were used with anodes having a thickness of about 13.0 microns of the oxides of 75% ruthenium/25% iridium upon graphite. The volume percent of parasitic oxygen in chlorine gas in the anode compartments was plotted against the concentration of the aqueous hydrogen chloride (in moles) exiting from the anode chamber after the oxidation of the aqueous hydrogen chloride in the cell. The graph showing these results is illustrated in FIG. 5 showing the effect of current density upon the volume percent of parasitic oxygen in the chlorine gas formed in the anode or at the anode/membrane interface. The current density in amps/ft.$^2$ was 400, 600, and 1,000, respectively. It can be seen from this data that even at 400 amps/ft.$^2$, the oxygen levels in the chlorine gas are very low.

EXAMPLE 4

A series of electrodes having various anode thicknesses were tested in electrolytic cells in accordance with the conditions and components set forth in Example 1. Anodes of various thicknesses are reported in Table 1 below. The cell temperature, the concentration (in moles) of the exiting aqueous hydrogen chloride and the cell voltage at a current density of 600 amps/ft.$^2$ are also reported in Table 1 below. The membrane surface having the anode with a thickness of 25.0 microns was well-covered with the anode material, and the electrode was clearly continuous. The anode having an anode material loading sufficient for a 3.0 micron thickness did not cover the membrane surface very well, and this electrode appeared highly discontinuous with very large areas of the membrane exposed after the bonding of the anode material thereto. The results are reported in Table 1 below.

TABLE 1

ELECTRICAL CELL PERFORMANCE FOR OXIDATION OF AQUEOUS HYDROGEN CHLORIDE WITH VARIOUS THICKNESSES OF ANODE MATERIAL

| Anode Thickness (microns) | Cell Voltage at 600 amps/ft.$^2$ | Cell Temp. (°C.) | Exit HCl (moles) |
|---|---|---|---|
| 50 | 1.92 | 47 | 7.7 |
| 25 | 1.76 | 53 | 8.1 |
| 23 | 1.79 | 54 | 4.8 |
| 6 | 1.87 | 50 | 5.9 |
| 3 | 2.10 | 55 | 9.8 |

The composite electrode comprising the anode, the solid polymer electrolyte membrane and the cathode wherein the anode had a thickness of about 3.0 microns, performed very poorly. There was 3 volume percent oxygen in the chlorine gas in the anode compartment at an aqueous hydrogen chloride concentration of 9.8 moles and a current density of 600 amps/ft.$^2$. The degradation in performance of the electrolytic cells for the electrolysis of aqueous hydrogen chloride with anodes having a thickness below about 6.0 microns, is clearly reflected in the cell voltages shown in Table 1 above.

The lower limit of the electrode thickness is determined by the particle size distribution of the material forming the electrode. When the electrode thickness approaches the mean particle size, the electrode becomes discontinuous, as discussed above for the anode having a thickness of 3.0 microns, and high local current densities result. It can be seen in the Table above that for the 75% ruthenium/25% iridium oxide catalyst upon graphite used as an anode material to prepare the anodes of the present invention, the lower limit lies between about 3 microns and 6 microns.

It can be determined from Table I above and from the other experimental data reported herein that the minimum thickness of the anode material in accordance with the present invention is about 6.0 microns. It has also been determined that the optimum thickness is about 10 microns to about 13 microns because these are thicknesses which are easily reproducible in the manufacture of membranes. Although the 6.0 micron thick electrode is operable in accordance with the present invention, anodes of that thickness are difficult to manufacture commercially.

Unless otherwise specified, the foregoing electrolysis cells for the electrolysis of hydrogen chloride had an anode surface of 9 in$^2$ (3"×3"). The cells were operated at about 50° C. unless otherwise specified. Direct current was applied to the electrodes. In all cases, the solid polymer electrolyte membrane was a cation exchange membrane supplied commercially by E. I. Dupont de Nemours & Co. under the trademark "NAFION". The ion exchange membrane was a perfluorocarbon sulfonic acid cation membrane wherein the ion exchange groups are hydrated sulfonic acid groups which are attached to the perfluorocarbon polymer backbone by sulfonation.

It was also found that oxygen evolution was suppressed by high pH which increases the reversible potential of the process and by high chloride ion concentration which facilitates the desired reaction. Thus, a high rate of transfer of hydrogen chloride is beneficial to system operation.

In accordance with the present invention, electrolysis of hydrogen chloride has been improved. A method and device have been provided which substantially reduce or eliminate oxygen evolution in an electrolysis cell of the type using a solid polymer electrolyte membrane having gas and liquid permeable electrodes bonded to the surfaces and physically forming a part of the membrane when chlorine is generated from aqueous hydrogen chloride.

The rate of transfer of hydrogen chloride in an aqueous medium in an anode chamber of an electrolysis cell from the reaction sites in the anode or at the anode/membrane interface has been improved by decreasing the diffusion path length within the anode catalyst and/or increasing porosity of the anode catalyst material. This permits the use of feed hydrogen chloride solutions of lower concentrations into the anode of an electrolytic cell in which chloride gas is generated from the hydrogen chloride. It also permits the electrolysis of hydrogen chlorise in an aqueous medium at higher current densities.

While other modifications of the invention and variations thereof which may be employed within the scope of the invention, have not been described, the invention is intended to include such modifications as may be embraced within the following claims.

What is claimed is:

1. A method for the electrolysis of hydrogen chloride in an electrolytic cell having a cation transporting solid polymer electrolyte membrane, a porous gas and liquid permeable catalytic anode having tortuous pores extending therethrough said anode being bonded to one surface of the solid polymer electrolyte membrane whereby hydrogen chloride and chloride ions diffuse through the pores toward the surface of the cation transporting membrane to be oxidized and form reaction products, and a cathode catalyst bonded to the other surface of the solid polymer electrolyte membrane, maximizing the transport rate of hydrogen chloride and chloride ions into said porous anode which comprises maintaining a minimum diffusion path within the anodes as a function of the thickness and porosity of the anode and the tortuosity of the pores whereby the rate of transport of the chloride ions to the electrode is sufficient to sustain the cell current essentially by discharge of the chloride ions to produce chlorine thereby minimizing co-evolution oxygen.

2. The method of claim 1, wherein the thickness of the anode catalyst is about 6.0 microns to about 50 microns.

3. The method of claim 1, wherein the thickness of the anode catalyst is about 10.0 microns to about 13.0 microns.

4. The method of claim 1, wherein the porosity is increased by increasing the particle size of powder components in the anode material.

5. The method according to claim 1 wherein the liquid and gas permeable porous anode has a void volume ranging between 60 and 90 percent.

6. The method according to claim 1 wherein void volume of the porous anode is between 60 and 75 percent.

7. The method according to claim 1 wherein the void volume of the porous anode is substantially 75 percent.

8. A method for reducing the amount of oxygen generated in the electrolysis of an aqueous chloride in an electrolytic cell having a hydrated cation transporting polymeric membrane, a cathode bonded to one surface of the membrane and a gas and liquid previous anode bonded to the other surface of the polymeric membrane wherein aqueous chloride and chloride ions diffuse into the anode and are oxidized therein to produce chlorine, maximizing the transport rate of aqueous chloride and chloride ion into the porous anode by maintaining a minimum diffusion path within the anode as a function both of the porosity of the anode and the anode thickness by maintaining the thickness of the anode between 6.0 microns to 50.0 microns whereby the rate of transfer of the chloride ions to the anode is sufficient to sustain cell current by discharge of the chloride ions while minimizing co-evolution of other electrolysis products.

9. The method of claim 8, wherein the thickness of the anode is about 10.0 microns to about 13.0 microns.

10. In an electrode for the electrolysis of hydrogen chloride in an electrolytic cell having a cation transporting solid polymer electrolyte membrane, a porous gas and liquid permeable catalytic anode having tortuous pores extending therethrough said anode being adapted to be bonded to one surface of a solid polymer electrolyte membrane, whereby chloride ions diffuse through the pores from one surface of the electrod towards the cation transporting membrane to which the electrode is adapted to be bonded, to allow the chloride ions to be oxidized there to form chlorine gas the improvement comprising said catalytic anode electrode being constructed to maximize the transport rate of hydrogen chloride and chloride ions into and within said pores which comprises a structure in which the diffusion path length of the pores is a function of the thickness and porosity of the anodes and the tortuosity of the pores whereby the rate of transfer of the chloride ions to the electrodes is sufficient to sustain cell current by discharge of the chloride ion while minimizing co-evolution of other electrolysis products.

11. The electrode of claim 10, wherein the thickness of the anode material is about 6.0 microns to about 50.0 microns.

12. The electrode of claim 10, wherein the thickness of the anode material is about 10.0 microns to about 13.0 microns.

13. The electrode according to claim 10 wherein the porous electrode has a void volume in between 60 and 90 percent.

14. The electrode according to claim 10 wherein the porous electrode porosity has a void volume between 60 and 75 percent.

15. The porous electrode according to claim 10 wherein the porosity of the electrode is substantially at 75 percent.

16. In an apparatus for the generation of chlorine from hydrogen chloride by electrolysis when the electrolysis is carried out in an electrolytic cell having a cation transporting solid polymer electrolyte membrane a porous, gas and liquid permeable catalytic anode bonded to one surface and a cathode bonded to the other surface of the membrane, the cation transporting membrane dividing the electrolytic cell into an anode chamber on the side of the membrane having the anode and into a cathode chamber on the side of the membrane having the cathode, means for providing electrical current at the anode and the cathode, feed means for feeding an aqueous hydrogen chloride anolyte into the anode chamber, means for removing chlorine and depleted hydrogen chloride anolyte from the anode chamber, and means for removing hydrogen from the cathode chamber, the improvement comprising an anode of a thickness of about 6.0 microns to 50.0 microns to minimize the diffusion path length to provide an increase in the rate of transport of hydrogen chloride and chloride ions towards the surface of the membrane.

17. The apparatus of claim 16, wherein the thickness of the anode material is about 10.0 microns to about 13.0 microns.

* * * * *